United States Patent [19]

Truppe et al.

[11] 4,079,918

[45] Mar. 21, 1978

[54] METHOD FOR CLOSING A TAP HOLE OF A METALLURGICAL VESSEL AND AN ARRANGEMENT THEREFOR

[75] Inventors: Meinhard Truppe, St. Georgen; Günter Poferl; Johann Hartl, both of Linz, all of Austria

[73] Assignee: Vereinigte Osterreichische Eisen- und Stahlwerke - Alpine Montan Aktiengesellschaft, Vienna, Austria

[21] Appl. No.: 749,120

[22] Filed: Dec. 9, 1976

[30] Foreign Application Priority Data

Dec. 17, 1975 Austria ..... 9573/75

[51] Int. Cl.[2] ..... C21B 7/12

[52] U.S. Cl. ..... 266/45; 164/154; 266/90; 266/272

[58] Field of Search ..... 164/154, 155; 266/45, 266/90, 195, 271, 272, 236

[56] References Cited

U.S. PATENT DOCUMENTS

| | | | |
|---|---|---|---|
| 689,585 | 12/1901 | Hartman | 266/272 X |
| 3,973,761 | 8/1976 | Pelletier et al. | 266/272 |

FOREIGN PATENT DOCUMENTS

| | | | |
|---|---|---|---|
| 2,108,822 | 5/1972 | France | 266/272 |

*Primary Examiner*—Roy Lake
*Assistant Examiner*—Paul A. Bell
*Attorney, Agent, or Firm*—Burns, Doane, Swecker & Mathis

[57] ABSTRACT

In a method of and apparatus for closing a tap hole of a metallurgical vessel for separating metal and slag compressed gas is introduced into the tap hole after the metal has been poured off, the gas being introduced in a direction contrary to the pouring-off direction of the metal. The gas is introduced in such a manner that air is sucked inwardly along the mouth of the tap hole to aid in the burning-off of deposits around such mouth.

6 Claims, 2 Drawing Figures

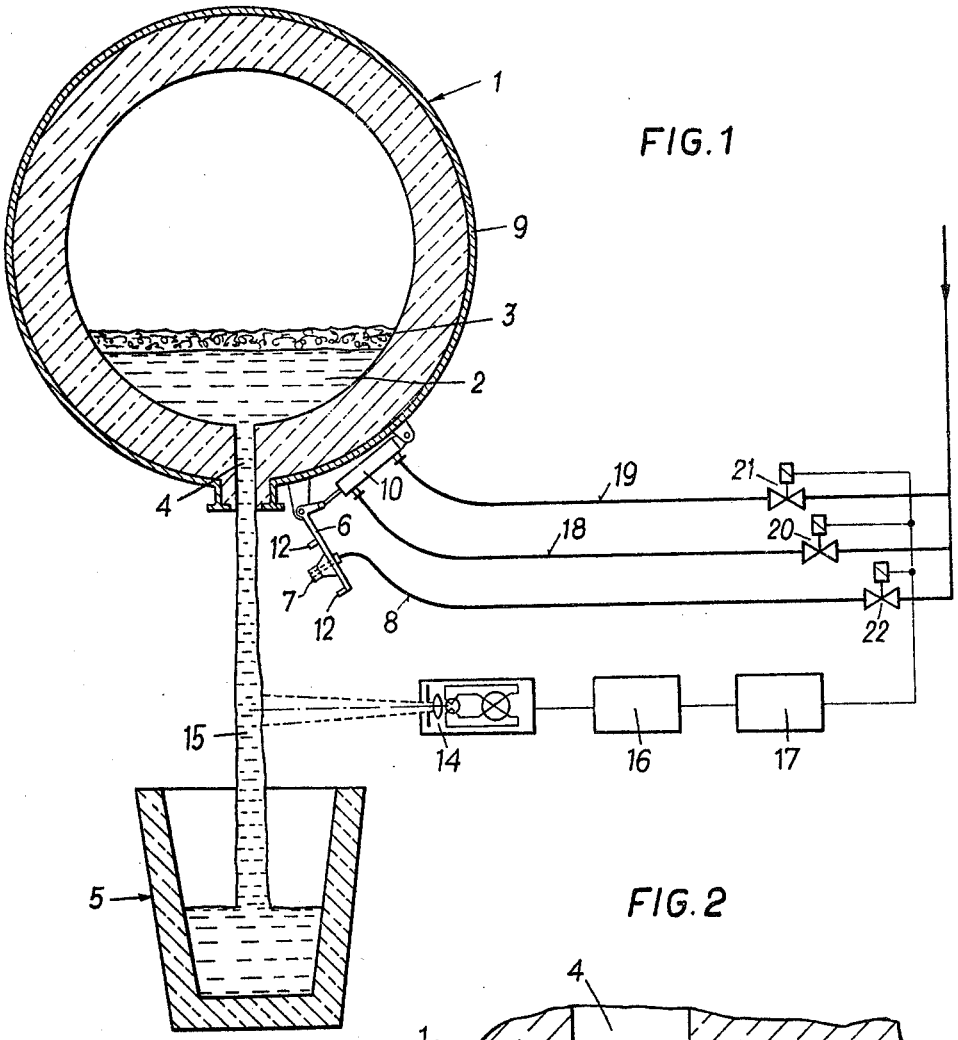
FIG. 1
FIG. 2
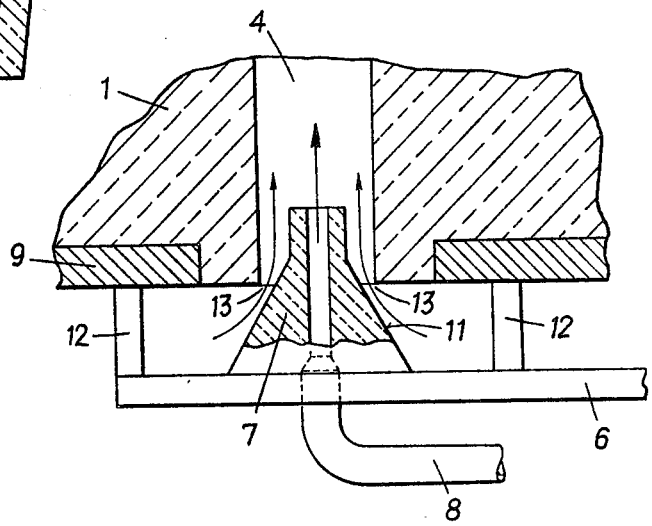

METHOD FOR CLOSING A TAP HOLE OF A METALLURGICAL VESSEL AND AN ARRANGEMENT THEREFOR

The invention relates to a method and a device for closing the tap hole of a metallurgical vessel for separating metal and slag, in particular during the tapping of steel melts.

When pig iron is refined to steel, oxidation reactions cause undesired accompanying elements having an affinity to oxygen, of the iron melt to be bonded to oxygen and the oxides formed to be liberated in gaseous form or to be transported into the slag. After refining, in many cases elements for deoxidation and alloying purposes have to be supplied to the steel, which elements have a higher affinity to oxygen than the undesired accompanying elements bonded in the slag. This has the consequence that such alloying elements can reduce the undesired accompanying elements in the slag, while they themselves slag. Moreover, refining slags can be very aggresive relative to the refractory material of melting vessel and casting ladle. Therefore, for qualitative and economical reasons, when tapping and alloying a melt in the ladle, one tries to prevent the running along of slag as far as possible. For melting vessels with tap holes, it has been proposed to use ceramic bodies having the shapes of balls and stoppers. The density of these bodies is greater than the density of the slag layer present on the melt, but smaller than that of the steel bath. As soon as the steel has run out of the melting vessel, the ceramic closure body is to tightly seal the tap hole and prevent the slag from running out.

Since the contours of a tap hole on the fire-side continuously change due to wear, one time and again has to count on a failure of the closure body with this method of slag-free tapping. Furthermore, the costs for the floating bodies which can be used only once, and of the mechanical means necessary for introducing them, are substantial. This especially has its effects on melting vessels for low tap weights.

The invention aims at preventing the above described disadvantages and difficulties and has as its object to create a method which enables a reliable closure of the tap hole of metallurgical vessels; the devices for carrying out the method are to be easy to handle, low in expenditures, and multiply usable.

The method according to the invention consists in that after pouring-off of the metal, compressed gas is introduced into the tap hole of the vessel contrary to the direction of pouring.

In order to find the right time for withholding the slag after the flowing-off of the metal, advantageously the pouring stream emerging from the tap hole is watched with a ratio pyrometer, wherein when the slag starts to flow out, a signal is received. Subsequently the compressed gas is introduced into the tap hole contrary to the pouring-off-direction.

When the invention is used in connection with the tapping of refined steel melts, due to the withholding of the reaction-avid refining slag in the melting vessel the slag cannot react with the refractory material of the tap hole and the ladle, whereby the durability of tap hole and ladle are considerably increased. By the compressed gas the slag is cooled so much that a thin, uniform slag film adheres to the jacket face of the tap hole, which film acts as protective layer during the next tapping and considerably increases the durability of the tap hole.

A device suitable for carrying out the method according to the invention is characterised in that a closure body containing a compressed-gas conduit is pivotable into the tap hole, which closure body leaves open an annular gap relative to the tap hole wall. Through the annular gap, air is sucked into the interior of the vessel, whereby when steel melts are tapped skull deposits formed during tapping at the mouth of the tap hole are burnt off by the oxygen of the air. Hitherto such deposits had to be pushed off from time to time or torn off, wherein damage to the tap hole mouth could hardly be avoided.

Suitably, the closure body is provided with an outer jacket tapering towards the mouth of the compressed-gas conduit and is arranged on a pivot arm having stops for limiting the pivot movement thereof in the direction towards the tap hole opening. Thereby the closure body is kept at a distance from the outer wall of the vessel, enabling the mouth of the compressed-gas conduit to be pivoted into the tap hole even when skull deposits are present.

Advantageously, the pivot axis of the pivot arm is arranged in a plane extending perpendicular to the tap hole axis.

For reaching a high emerging speed of the compressed gas, the closure body advantageously is designed as nozzle head.

The invention shall now be explained in more detail by way of example only and with reference to the accompanying drawings, wherein:

FIG. 1 is a section through the refining vessel during the pouring-off of a steel melt into the casting ladle also shown in section, and FIG. 2 is a section of the closed tap hole along its axis on an enlarged scale.

In a refining vessel denoted by 1 there is the steel melt 2 with the slag layer 3 floating thereupon. The steel flows through a tap hole 4 into the pouring ladle 5 arranged therebelow. For closing the tap hole, there is provided a closure body 7 secured to a pivot arm 6, to which closure body 7 the compressed-gas conduit 8 is connected. The pivot arm 6 is hinged to the outer jacket 9 of the refining vessel 1 and pivotable by a pressure medium cylinder 10 which can be actuated in both directions and is also hinged to the outer jacket of the vessel. The closure body 7 is provided with an outer jacket 11 tapering towards its mouth. Stops 12 provided on the pivot arm 6 prevent the closure body from completely closing the tap hole; thus there remains an annular gap 13.

Closure of the tap hole is effected in the following manner: As soon as the steel has flown off into the pouring ladle 5, the slag 3 flows out through the tap hole 4. A ratio pyrometer 14 by which the flowing-out steel 15 is watched gives an impulse at the change from steel to slag, which impuls actuates a relay 17 via an amplifyer 16, which relay transmits an electric signal to the magnetic valves 20, 21, 22 installed in the supply conduits 18, 19, 8 of the pressure medium cylinder 10 and the closure body 7. The magnetic valve 21 is opened, whereby the pressure medium cylinder 10 causes the pivot arm 6 to be rotated into the closing position illustrated in FIG. 2. At the same time the magnetic valve 22 of the supply conduit of the closure body is actuated, whereby the closure body, which in the pivoted-back position shown in FIG. 1 is actuated with a partial pressure of the compressed gas for the purpose of cooling, is actuated with the full pressure of the compressed gas. After reaching the closing position illustrated in FIG. 2, the compressed gas emerging causes air to be sucked on through the annular gap 13 according to the injector principle, indicated in FIG. 2 by arrows. This aids in the burning-off of skull deposits around the mouth of the tap hole. Due to the compressed gas - air jet, the slag is forced back into the refining vessel and subsequently can be poured-off into a separate slag vessel. As compressed gas e.g. air under pressure, argon or nitrogen can be used.

The beginning of the running along of the slag during tapping is indicated by the ratio pyrometer 14 with almost no delay. The time interval up to the closure of the tap hole depends on the dimension of the compressed-air cylinder and can additionally be influenced via a time relay.

Tests with a 5-metric-ton-LD-converter (i.e. top blowing converter) have shown that by the method according to the invention the pouring ladle slag, consisting of converter slag, deoxidation products and the wear of the lining of the pouring ladle, weighed upon termination of pouring, of an average of 40 kg/metric ton of pig iron could be reduced to 10 kg/metric ton of pig iron, without reducing the output of steel. With larger converter units, the ratios are substantially better still.

The consumption of compressed gas for the cooling of the closure body amounted to approximately 0.5 $Nm^3$/minute and in the closing position of the closure body to approximately 8 $Nm^3$/minute.

Besides the reduction of the casting ladle slag and the rephosphorization going hand in hand therewith, also higher durabilities of the tap hole and the casting ladle are achieved by using the method according to the invention.

What we claim is:

1. In a method for closing a tap hole of a metallurgical vessel, for separating metal and slag, in particular when tapping steel melts, the improvement which comprises inserting a closure body into the tap hole in a manner leaving an annular gap between the closure body and the tap hole, introducing compressed gas through a passage in the closure body into the tap hole after the metal has been poured off and counter to the pouring-off direction of the metal so that air is sucked-in through the gap.

2. A method as set forth in claim 1, wherein the metal flowing out of the tap hole is watched with a ratio pyrometer in order to obtain a signal when the slag starts to flow out, whereupon the compressed gas is introduced into the tap hole.

3. An arrangement at a metallurgical vessel with a tap hole provided in a wall of the vessel, for separating metal and slag, comprising a closure body for the tap hole and a compressed-gas conduit contained in the closure body and pivot means for pivoting the closure body into the tap hole, the closure body being so designed that, when pivoted in the tap hole, an annular gap remains free between the closure body and the tap hole and the mouth of the compressed-gas conduit faces toward the interior of the tap hole.

4. An arrangement as set forth in claim 3, wherein the closure body has an outer jacket tapering toward the mouth of the compressed-gas conduit, and wherein said pivot means is a pivot arm, stops being provided on the pivot arm to limit the pivoting movement thereof in tap hole direction.

5. An arrangement as set forth in claim 3, wherein the pivot means is a pivot arm and the pivot arm has a pivot axis extending in a plane that is perpendicular to the axis of the tap hole.

6. An arrangement as set forth in claim 3, wherein the closure body is designed as nozzle head.

* * * * *